United States Patent [19]

Beisser

[11] Patent Number: 4,639,705

[45] Date of Patent: Jan. 27, 1987

[54] TRANSFORMER WITH GAPLESS CORE ON SUPPORT

[76] Inventor: Jean-Claude Beisser, Pierre Grise, La Chaux-de-Fonds, Switzerland, CH-2300

[21] Appl. No.: 706,296

[22] Filed: Feb. 27, 1985

[30] Foreign Application Priority Data

Mar. 6, 1984 [FR] France ..... 84 03465

[51] Int. Cl.[4] ..... H01F 33/02; H01F 27/26; H01F 27/30

[52] U.S. Cl. ..... 336/5; 336/196; 336/198; 336/213; 336/215

[58] Field of Search ..... 336/5, 10, 12, 65, 92, 336/196, 198, 208, 213, 214, 215, 234

[56] References Cited

U.S. PATENT DOCUMENTS 2,490,506 12/1949 Broverman ..... 336/213 X 3,060,353 10/1962 Shansky et al. ..... 336/213 X 3,129,399 4/1964 Hansen ..... 336/213 X

*Primary Examiner*—Thomas J. Kozma

*Attorney, Agent, or Firm*—Wenderoth, Lind & Ponack

[57] ABSTRACT

An electric transformer includes a magnetic circuit and, for each phase, an electrical winding including at least one coil, wherein each electrical winding is made of a good conductive material wire or band, notably aluminum, wound about a wheel rim-shaped annular former. Each magnetic circuit is made of at least one elementary circuit, provided by coiling a magnetic metal strip of constant width, and is formed with a window for the passage of the corresponding winding or windings, has the shape of an irregular polygon with an axis of symmetry. The magnetic circuits are positioned and maintained on a support plate allowing the passage of the windings.

10 Claims, 11 Drawing Figures

TRANSFORMER WITH GAPLESS CORE ON SUPPORT

FIELD OF THE INVENTION

The present invention relates to an electrical transformer of any working rate, monophase or polyphase, and its manufacturing method.

BACKGROUND OF THE INVENTION

Various ways are known to provide a transformer:

1. one begins by forming the electrical windings, then the magnetic circuit is formed around the electrical windings. This is the method which is generally used in Europe. Its main disadvantage is the discontinuity of the magnetic circuit (which is made either by coiling strips and cutting, or by the juxtaposition of parts cut from the strips), which represents a highly negative element for reaching an optimum economic efficiency. Moreover, the magnetic material is not fully used;
2. or, a magnetic circuit is first made, then the electrical windings are coiled about the circuit thus obtained. The coiling operation can be carried out by using a toric coiling machine, but this technique is time-consuming and therefore costly, and is limited by the capacities of the presently available machines. The coiling can also be performed by rotating a cylindrical support about the magnetic circuit while winding the conductive wire or band on said support. This technique is of great interest but its development encounters the following practical difficulties, which are not yet overcome:
   - the coiling speed remains low, due to the small clearance between the winding support and the magnetic circuit, and due to the difficulty of positioning and stabilizing said two elements for this operation;
   - the inputs and outputs of the electrical windings present problems, notably as regards their location, their passage through the windows of the magnetic circuits during coiling, and their protection during such operation;
   - the adjustment, which is made after, of the electrical windings on the magnetic circuit remains difficult, and has to be done by the use of auxiliary mechanical systems which are complex and costly. The resistance to dynamic efforts, when short-circuits appear, of the electrical windings-magnetic circuit assembly, which is vital for the transformer, depends on this adjustment.

On the other hand, for practicing the two above methods, the materials are not used to their maximum capacity. Therefore, these known methods do not allow tending toward the smallest economic cost, as regards the manufacture and operation of the transformers thus made as well as the energy consumed ("Iron" losses due to the magnetic circuit and "Copper" losses due to the windings).

OBJECTS AND SUMMARY OF THE INVENTION

The object of the present invention is to remedy these disadvantages by providing a transformer which can be produced quickly, with a production investment considerably smaller than that presently necessary, meanings by way of consequence a great reduction of cost, such cost being further reduced by a reduction of the manufacturing costs of the electrical windings and of the mechanical circuits. Finally, the transformer which is the object of this invention is characterized by a small operating cost since the invention is particularly adapted to the use of amorphous materials, which are very low energy-consumers, for their manufacture as well as for their use for making the magnetic circuits, thus providing windings of small weight, and therefore low in energy consumption when in operation.

A transformer according to the invention is substantially characterized in that it comprises: at least one electrical winding, made of a wire or band of a good conductive metal such as aluminum, wound about an annular former, and at least one magnetic circuit made of at least one elementary circuit, provided by the coiling of magnetic metal strips, which is formed with a window for the passage of the winding, in the shape of an irregular polygon having an axis of symmetry.

According to an embodiment of the invention, a polyphase transformer is characterized in that its windings are disposed contiguous at their internal faces, such that planes of such internal faces of the windings form a dihedral at angles of 60°, the magnetic circuits encompassing the windings two by two, for each of them.

According to the invention, the magnetic circuits are positioned and maintained on a support provided in the shape of a plate allowing the passage of the windings, and the configuration of which is such that they do not form a turn encompassed by the windings.

BRIEF DESCRIPTION OF THE DRAWINGS

Other features and advantages of this inention will become more apparent from the following description, with reference to the accompanying drawings illustrating embodiments thereof, without any limiting character, in which.

DETAILED DESCRIPTION OF THE INVENTION

Figure 1:
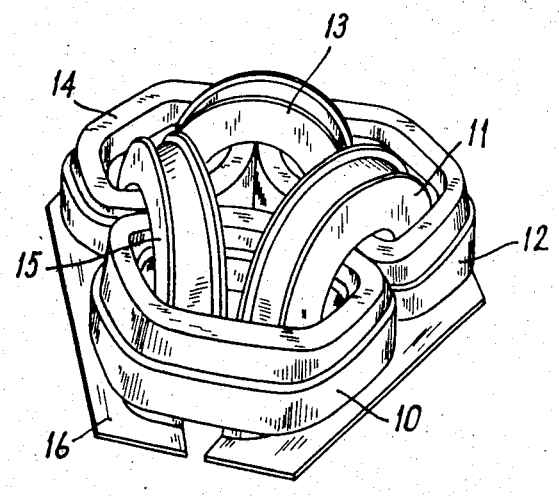
FIG. 1 is a perspective view of a three-phase distribution transformer according to the invention.

FIG. 1 shows, by way of a non limiting example, a three phase transformer according to the invention. Said transformer is comprised substantially of:

- three magnetic circuits 10, 12, 14, each made of a plurality of elementary circuits, provided for example by coiling magnetic metal strips;
- three high and low voltage electric windings 11, 13, 15, each formed of a wire or of a strip of a good conductive metal such as aluminum, wound about an annular former, as will be described in detail hereafter, and supported by the same device, for each of the high and low voltage couples, a plate 16 for supporting the magnetic circuits and the electrical windings; and means for maintaining the windings (not visible in FIG. 1 but described hereafter in detail with reference to FIG. 10).

Figure 3:
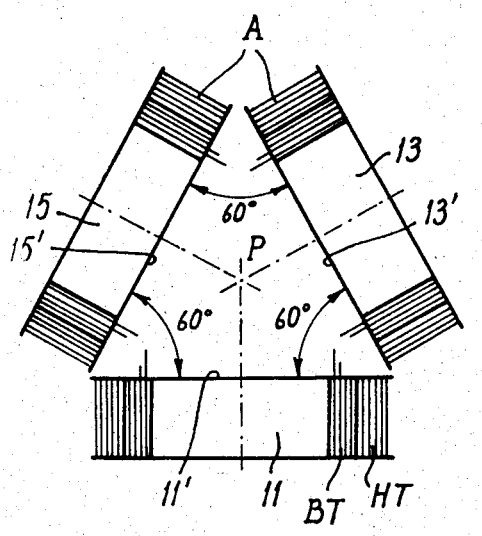
FIG. 3 is a plane view of FIG. 2.
Figure 2:
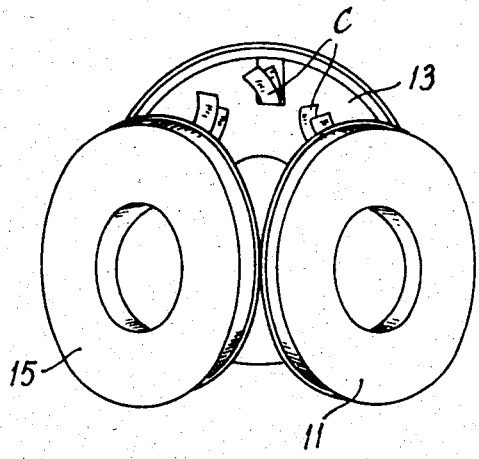
FIG. 2 is a perspective view of the three electrical windings of the transformer according to FIG. 1.
Figure 5:
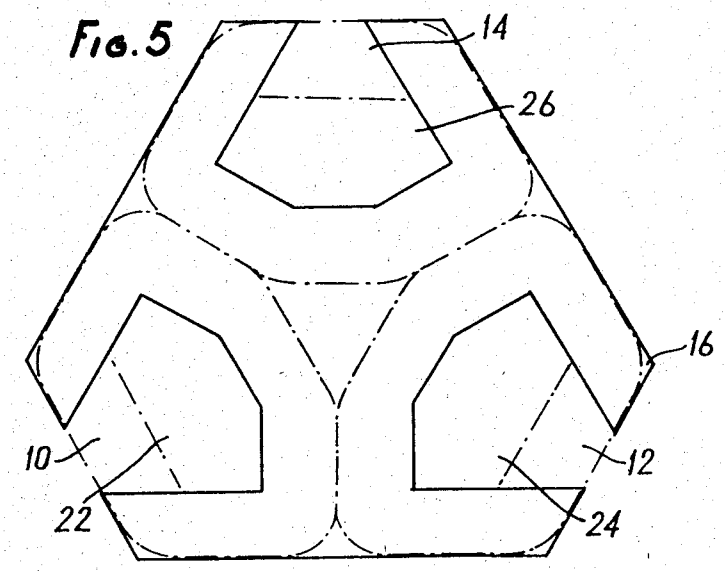
FIG. 5 is a plan view of a plate-shaped support of the transformer according to claim 4.

Windings 11, 13 and 15 are disposed such that the planes comprising their internal faces 11', 13' and 15' form trihedrals with an angle of 60°, the apexes of which form the tangence points of the windings, the radial axes of the windings being in the same plane (FIG. 3). According to the invention, each electrical winding, high or low voltage, is provided from an aluminum wire or strip A, wound about a former having the shape of a wheel rim. Each winding has a small width compared with usual such widths, and has a small number of turns. The input and output connections C of each winding 11, 13 and 15 emerge at the interior surface of each winding annular former (FIG. 2).

Figure 4:
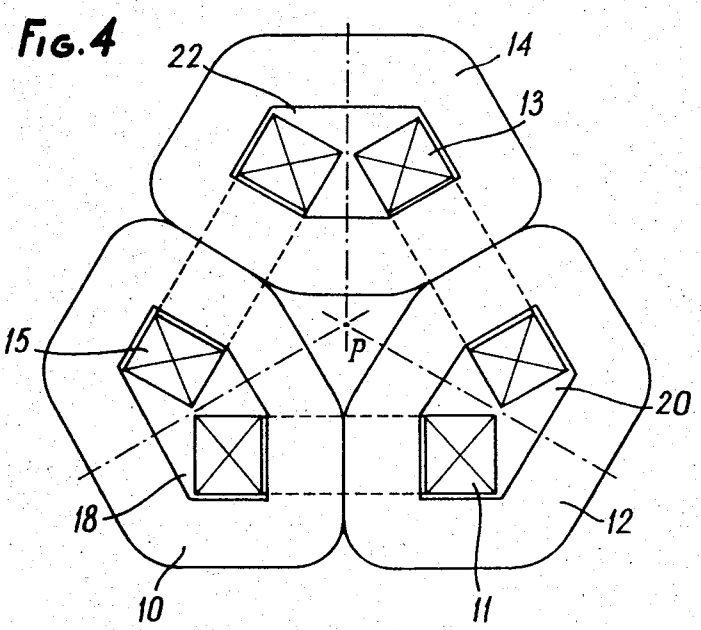
FIG. 4 is a plan view of the three-phase transformer according to FIG. 1.

The magnetic circuit of the transformer shown in FIGS. 1 through 5 is therefore made of three strictly identical elements 10, 12, 14, each of them encompassing two successive windings. Window 18, 20, 22 respectively of each elementary magnetic circuit 10, 12, 14 is in the shape of an irregular polygon, with six sides in this non limiting embodiment, but having an axis of symmetry. As can be seen in FIG. 4, the axes of symmetry of each of the windows meet at a common point P, which is also the point of conjunction of the axes of each winding.

Each magnetic circuit such as 10, 12, 14 is made of elementary circuits, manufactured for example by coiling a magnetic strip, for example of amorphous materials, of constant width about a winding former. The circuits are disposed on the support plate 16, by stacking of their elementary components, which are secured against motion, for example by means of glue points. The magnetic circuits are at no moment in permanent contact with the windings 11, 13, 15 or with their coil formers. Therefore, they are not subjected to dynamic efforts, the only stresses exerted on them being those due to their own weight. The invention makes it possible to provide magnetic circuit elements of different sizes but of constant width, which is a definite advantage notably when using amorphous materials (possibility of storing ony a single width, for manufacturing transformers of various power rates).

Figure 6A:
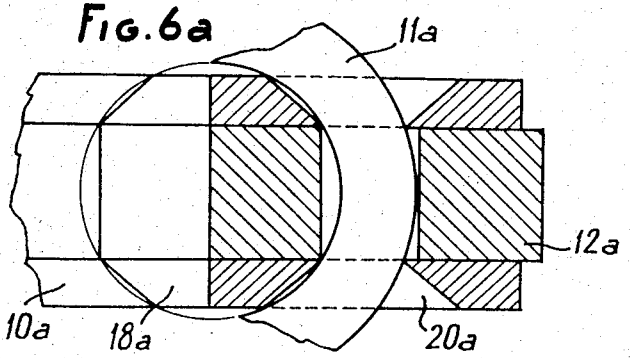
FIGS. 6 and 6*a* are vertical sectional views, at different scales, showing two embodiments of the magnetic circuits of a transformer according to this invention.
Figure 6:
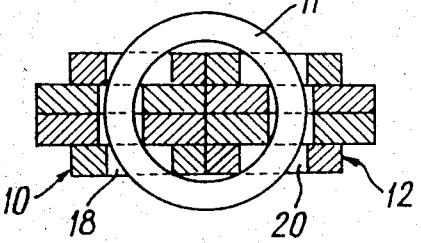

The section of each magnetic circuit can be inscribed in a half circle (FIGS. 6 and 6*a*). For example, such a section can present steps as shown in FIG. 6, said section being obtainable by successive windings of magnetic material strips of definite width. This section can also be polygonal as shown in FIG. 6*a*, where two magnetic circuits 10*a*, 12*a* of polygonal section and encompassing a winding 11*a* are shown. In this case, the polygonal section can also be provided by coiling strips of polygonal shape, wound according to their main axis, said polygonal strips being generally obtained by cutting strips with parallel edges slantwise. Without departing from the scope of this invention, any other shape of the section different from those shown in FIGS. 6 and 6*a* can be used.

The support plate 16 receiving the magnetic circuits 10, 12, 14 is a metallic plate of sufficient thickness for supporting the weight of the magnetic circuits and of the windings, without having deformations. As is visible in FIG. 5, the shape of said support plate 16 is such that it encompasses the outer contour of the magnetic circuits 10, 12, 14, and is formed with three opening outwardly recesses 22, 24, 26 in order that the support plate does not form, for each winding, a parasitic turn having a disturbing effect.

The magnetic circuits are maintained on the support plate by any appropriate means which oppose sliding, for example catches (not shown in the drawing).

The means provided by the invention for supporting windings 11, 13 and 15 will now be described, particularly with reference to FIGS. 9 and 10, FIG. 10 being a view from below of support plate 16, that is in a position turned over with respect to that of FIG. 1.

Figure 10:
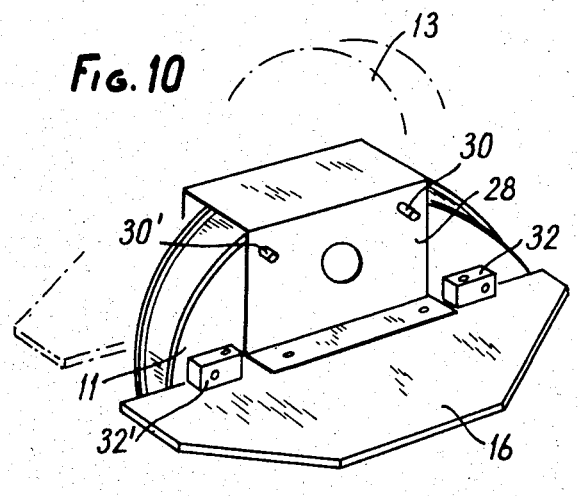
FIG. 10 is a view from below showing the mode of fixation of an electrical winding.

In this non limiting embodiment, said means comprise, for each winding such as 11, a cap or cover 28, provided from a folded metal sheet, which caps the portion of the winding projecting underneath the support plate 16, as shown in FIG. 10. Said cap 28 is fixed on plate 16 and includes, in its lower portion (FIG. 10 being in a position turned over with respect to the effective position) two rolling axes 30 and 30' on which bear the annular former of winding 11. Said axes rotate inside cap 28 and allow therefore the rotation of the former of winding 11 with respect to said cap, thereby providing an axial and radial positioning of each former, and therefore of each corresponding winding such as 11, relative to plate 16. Then, the former of each winding such as 11 is rigidly connected to the support plate 16 in order that the various windings be positioned with precision with respect to the magnetic circuits. To this end, fixation members 32, 32' are fixed to plate 16 and to flanges of the winding formers.

Figure 9:
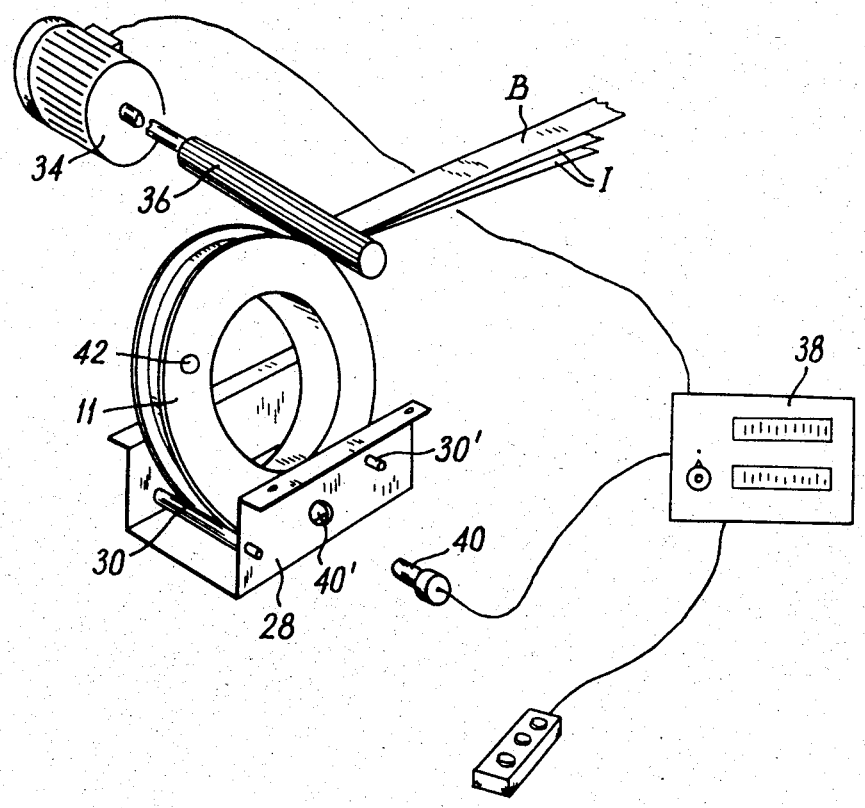
FIG. 9 is a perspective schematic view of a device according to the invention for providing a winding of a transformer which is the object of this invention.

Cap 28 can also be used according to the invention for coiling the conductive material wires or strips on the annular formers, as shown in FIG. 9.

In fact, the coiling of the windings is performed by subjecting a former 11 to a rotary motion on shafts 30 and 30', by using a geared motor 34 driving shaft 36, coated for example with rubber, applied on the periphery of two flanges of the former. The coiling of strip B of conductive material (preferably aluminum) and of its insulation bands I is controlled by using an electronic counter 38, operated by a magnetic detector 40 positioned in an 40' provided in cap 28, and energized by a counting metallic pellet 42, attached to the former outer flange. This arrangement makes it possible to form very accurately each winding of the transformer of this invention. To this device can be associated a microprocessor providing a robotization of all the operations.

The device just described makes it possible to provide winding former assemblies which are mechanically very robust, supporting the electro-dynamic efforts during short-circuits.

The annular formers on which are wound the windings can be obtained in various ways. For example, they can be made of two side flanges or webs, each provided with an axial recess including a shoulder, so that an insulating band forming the axis of the former can be wound about the shoulders. Thereby is provided a spool with an insulated axis ensuring the continuity of the insulation of the windings opposite the portions of the magnetic circuit inside each winding, which is an important advantage compared to the devices of the prior art where this advantage is obtained by using costly and fragile fittings.

The various steps of the manufacturing method of the transformer of this invention are the following:

1. coiling of the elementary magnetic circuits which are later to form the circuits 10, 12, 14;
2. annealing of the magnetic circuits thus made;
3. checking of the circuit characteristics:
   magnetic (measurement of the VA and Watts);
   dimensional
4. concurrently to the above operations, cutting out of the support plate 16, boring of recesses 22, 24, 26 in said plate, deburring and fixing insulation in order to avoid short-circuiting the turns of the magnetic circuits bearing on the plate;
5. cutting and folding of the caps 28 supporting the windings 11, 13, 15,
6. providing the rolling shafts 30, 30', and mounting of said shafts in the respective caps 28,
7. mounting of caps 28 on plate 16, which is to support the magnetic circuits,
8. mounting of the magnetic circuits 10, 12, 14 on support plate 16;
9. mounting of the annular formers for coiling the windings,
10. coiling of windings 11, 13, 15, high and low voltage,
11. adjustment and fixation of windings 11, 13, 15 on caps 28, for example by using systems such as fixation members or cubes 30, 32' described above,
12. checking, and in the case of a transformer immersed in a tank:
    drying in an oven (said operation being performed very quickly due to the absence of any wooden parts, thus saving energy as well as time),
    setting in the tank, wiring (mechanical assembly with screws and nuts or plug-in lugs),
    setting under vacuum, filling up with oil, and
    final check.

The invention is not limited to polyphase transformers, but also applies, in the same way as described above, to monophase transformers.

Figure 7:
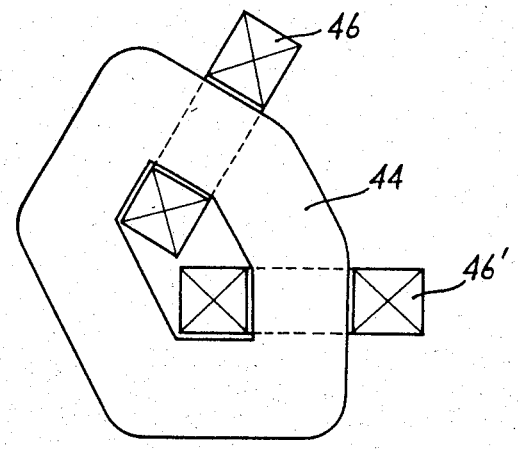
FIGS. 7 and 8 show two embodiments of a monophase transformer according to this invention.
Figure 8:
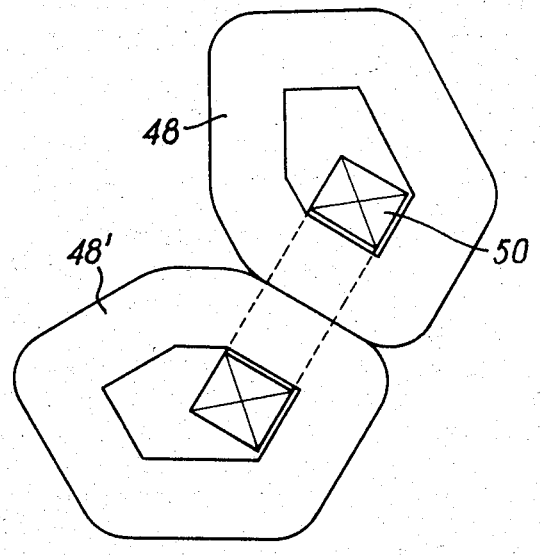

FIG. 7 shows an embodiment of a monophase transformer according to this invention, including a magnetic circuit 44 and two electrical coil windings 46, 46', and FIG. 8 shows an embodiment of a monophase transformer according to this invention, comprising two magnetic circuits 48, 48' and a single electrical winding 50.

It is clear that the present invention is not limited to the various embodiments described above and/or shown and that it encompasses all their alternatives.

What I claim is:

1. An electric transformer comprising:

at least one electrical winding made of a conductive material wound about a wheel rim-shaped annular former;

at least one magnetic circuit made of at least one elementary circuit provided by coiling a magnetic metal strip of constant width into a gapless core with a window, said at least one magnetic circuit having the shape of an irregular polygon with an axis of symmetry;

a support plate having a recess;

said at least one magnetic circuit being positioned and maintained on said support plate with said window aligned with said recess; and said at least one winding extending through said recess and said window and surrounding said plate and said at least one magnetic circuit.

2. An electric transformer as claimed in claim 1, comprising a plurality of said windings in polyphase disposed contiguously at inner faces thereof, such that planes of said inner faces of said windings form a dihedron with an angle of 60°, and a plurality of said magnetic circuits, each of said magnetic circuits encompassing two of said windings.

3. A transformer as claimed in claim 1, wherein said at least one winding comprises a small number of turns, and input and output connections of high and low voltage open to an outer surface of said wheel rim-shaped annular former.

4. A transformer as claimed in claim 1, wherein said at least one magnetic circuit is made of the stacking of elementary components on said support plate, said components being secured against motion on said plate so as to be at no time in permanent contact with said at least one winding.

5. A transformer as claimed in claim 1, wherein said at least one magnetic circuit has a section inscribed in a half circle, and said section is formed with steps.

6. A transformer as claimed in claim 1, wherein said support plate is a metallic plate surrounding the outer contour of a plurality of said magnetic circuits supported thereby, said plate being formed with plural recesses.

7. A transformer as claimed in claim 6, wherein said recesses formed in said plate are opened toward the outside of said plate, so that said support plate does not form a parasitic turn.

8. A transformer as claimed in claim 1, wherein said at least one winding is positioned in a support provided in the shape of a cap fixed beneath said support plate and having two parallel axes on which bear said at least one winding, which can thus be driven in rotation on said axes, so as to be positioned accurately radially and axially prior to being fixedly connected to said support.

9. A transformer as claimed in claim 8, wherein said at least one winding is formed of a low voltage coil made from a conductive strip and of a high voltage coil made from a conductive strip and is obtained by subjecting said annular former to a rotary motion on axis, forming rotary bearings, by using a geared motor driving a shaft applied on the periphery of said former, the coiling being controlled by an electronic counter operated by a detector energized by a counting pellet places on a flange of said annular former.

10. A transformer as claimed in claim 1, wherein said at least one magnetic circuit is made from amorphous magnetic materials.

* * * * *